United States Patent [19]

Jeschke et al.

[11] 4,391,392

[45] Jul. 5, 1983

[54] SLIDING CLOSURE UNIT

[75] Inventors: Peter Jeschke, Walluf; Jürgen Plath, Wiesbaden, both of Fed. Rep. of Germany

[73] Assignee: Didier-Werke A.G., Wiesbaden, Fed. Rep. of Germany

[21] Appl. No.: 292,188

[22] Filed: Aug. 12, 1981

[30] Foreign Application Priority Data

Aug. 20, 1980 [DE] Fed. Rep. of Germany ..... 3031377

[51] Int. Cl.[3] ..... B22D 41/08

[52] U.S. Cl. ..... 222/598; 222/600

[58] Field of Search ..... 222/598, 600, 597; 266/271, 272

[56] References Cited

U.S. PATENT DOCUMENTS 3,511,261 5/1970 Bick et al. ..... 222/600

3,831,825 8/1974 Kutzer et al. ..... 222/600

OTHER PUBLICATIONS

*The Iron Age;* Jul. 19, 1928, p. 155, "Ladle Nozzle Made of Two Materials".

*Primary Examiner*—David A. Scherbel

*Attorney, Agent, or Firm*—Wenderoth, Lind & Ponack

[57] ABSTRACT

A sliding closure unit for selectively discharging liquid melt from a liquid melt container includes a stationary refractory plate and a sliding refractory plate, the two refractory plates having complementary, abutting relative sliding surfaces. The stationary refractory plate consists essentially of a substantially non-wettable material having a Mohs' hardness of from 1 to 2, a thermal conductivity of greater than 40 W/km at 700° C. and a crushing strength of not greater than 25 N/mm$^2$ at about room temperature. The sliding refractory plate consists essentially of a substantially non-porous material having a Mohs' hardness of from 6 to 7, a thermal conductivity of less than 3 W/km at 700° C. and a crushing strength of greater than 300 N/mm$^2$ at approximately room temperature.

6 Claims, 1 Drawing Figure

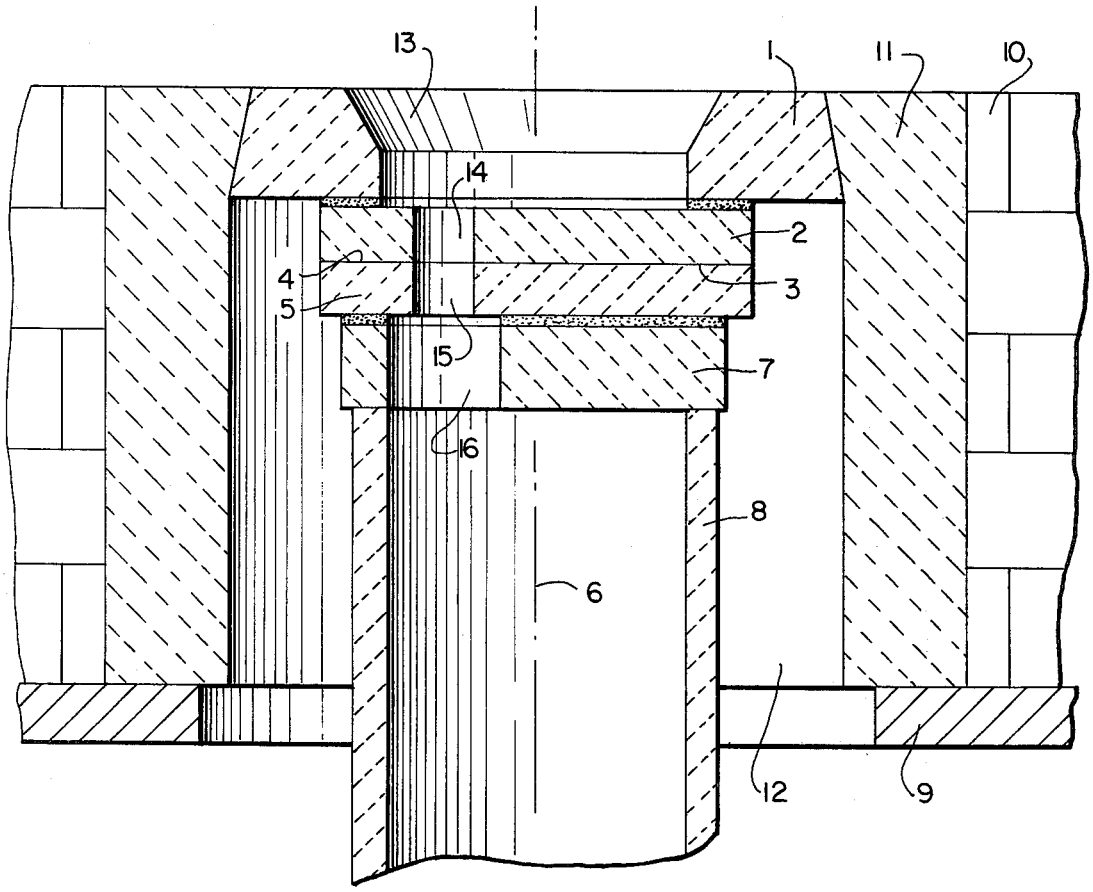
13
1
11
10
14
2
4
3
5
15
7
16
8
6
12
9

SLIDING CLOSURE UNIT

BACKGROUND OF THE INVENTION

The present invention relates to an improved sliding closure unit for selectively discharging liquid melt from a liquid melt container of the type including an outer jacket, an inner refractory lining and a pouring opening extending through such lining. This type of sliding closure unit is employed in cooperation with the melt container to selectively block and unblock the pouring opening. Such sliding closure unit includes a stationary refractory plate having therethrough a flow passage for communication with the pouring opening, a sliding refractory plate in abutting contact with the stationary refractory plate and having therethrough at least one flow passage to be selectively moved into and out of alignment with the flow passage of the stationary refractory plate, the stationary and sliding refractory plates having complementary, abutting relative sliding surfaces.

This type of sliding closure unit is extensively employed in the steel making industry and is particularly suitable therefor due to the consistency of the melt materials involved. However, the use of this type of sliding closure unit for various non-ferrous melted metals presents certain inherent difficulties. Such non-ferrous metals, particularly aluminum, become relatively highly superheated and are poured with a correspondingly high degree of fluidity. As a result, the aluminum melt penetrates easily between the sliding surfaces of the stationary refractory plate and the sliding refractory plate and into the open pores of the sliding surfaces. This disadvantage of light non-ferrous metals is much less of a problem with liquid steel due to the consistency thereof. Once the melted material has infiltrated between the refractory plates and becomes solidified thereat, further infiltration and solidification rapidly increase, and in many cases results in failure of the closure unit.

SUMMARY OF THE INVENTION

With the above discussion in mind, it is an object of the present invention to provide an improved sliding closure unit which greatly inhibits the penetration of liquid melts between the relative sliding surfaces of the stationary refractory plate and the sliding refractory plate, and to accordingly counteract the solidification therebetween of the penetrated liquid melt.

This object is achieved in accordance with the present invention by providing the stationary refractory plate to consist essentially of a substantially non-wettable material having a Mohs' hardness of from 1 to 2, a thermal conductivity of greater than 40 W/km at 700° C. and a crushing strength of not greater than 25 $N/mm^2$ at approximately room temperature, and by providing the sliding refractory plate to consist essentially of a substantially non-porous material having a Mohs' hardness of from 6 to 7, a thermal conductivity of less than 3 W/km at 700° C. and a crushing strength of greater than 300 $N/mm^2$ at about room temperature.

By providing the sliding surface of the stationary refractory plate of such a soft material and by providing the sliding refractory plate of such a hard material, there is provided a permanent and sufficient lubrication between the relative sliding surfaces which substantially prevents the infiltration of highly fluid melted material between the relative sliding surfaces. Additionally, the high thermal conductivity of the stationary refractory plate and the low thermal conductivity of the sliding refractory plate produce a heat concentration at the relative sliding surfaces such that any melted material which might possibly have become infiltrated in small amounts between the relative sliding surfaces remains liquid and does not become solidified. This heat concentration can, if necessary, be increased by the suitable location of insulating material and/or by additionally heating the stationary refractory plate.

The stationary refractory plate preferably consists essentially of carbon having a graphite content of at least 90% by weight. Further preferably, the sliding refractory plate contains at least 90% by weight of a material selected from the group consisting of zirconia and alumina. The stationary refractory plate can be a tempered, not annealed at high temperature, carbon block. Granular carbon which has been graphitized is generally known as a raw material for the production of graphite electrodes. This same raw material, after being pressed into a block shape and then tempered, can be employed as the stationary refractory plate.

The sliding refractory plate preferably contains at least 90% by weight of a material selected from the group consisting of zirconia and alumina. The sliding refractory plate can be made of a mixture of oxides, containing at least 90% by weight of zirconia ($ZrO_2$) or alumina ($Al_2O_3$), in the form of a burried, stone or brick. There can be other oxides in the mixture in addition to the zirconia or alumina, such as $SiO_2$, $Cr_2O_3$ and $Fe_2O_3$.

In a particularly advantageous arrangement, the sliding closure unit may be a rotary sliding closure unit which extends inwardly through the jacket of the liquid melt container and into the inner refractory lining, and the pouring opening extending through the lining may be widely funneled. Accordingly, the relative sliding surfaces between the stationary and sliding refractory plates are subjected to heat of the melt within the melt container, thereby further protecting against solidification of any slight amount of liquid material which might have infiltrated between the relative sliding surfaces. However, it is to be understood that the present invention is not limited to such a rotary sliding closure unit, but rather may be employed for other known types of sliding closure units, such as linear or swivel sliding closure units wherein the stationary and sliding refractory plates are located exteriorly of the jacket of the melt container.

BRIEF DESCRIPTION OF THE DRAWING

Other objects, features and advantages of the present invention will be apparent from the following detailed description, taken with reference to the accompanying drawing, wherein the single figure is a longitudinal cross-sectional view through a sliding closure unit according to one particularly acvantageous embodiment of the present invention.

DETAILED DESCRIPTION OF THE INVENTION

With reference now to the drawing, the illustrated embodiment of the improved sliding closure unit of the present invention is a rotary sliding closure unit which extends through an opening in an exterior jacket of a liquid melt container into the interior of a refractory sleeve thereof. As indicated above, however, the concept of the present invention is not limited to this specific type of sliding closure unit, but rather is applicable to other types of sliding closure units, such as those having linear or swivel sliding movement and which are located exterior of the liquid melt container jacket.

Thus, as illustrated in the drawing, there is shown a liquid melt container including an outer metal jacket 9 and an inner refractory lining 10. A refractory sleeve 11 is arranged at an opening in the jacket 9. A discharge brick 1 is fitted within refractory sleeve 11 and has a wide funneled pouring opening 13.

A rotary sliding closure unit extends through the opening in jacket 9 and into the interior of refractory sleeve 11, to define therein an annular free space 12 into which mechanical elements for rotation of the rotary plate of the rotary sliding closure unit are housed. Since these mechanical elements form no part of the present invention and are otherwise understood by those skilled in the art, they are not illustrated or described. The rotary sliding closure unit includes a stationary refractory plate 2 which is stationarily mounted with respect to discharge brick 1 in a known manner, and a rotary refractory plate 5 mounted in a known manner beneath and against stationary refractory plate 2 for rotation about an axis 6. Plates 2 and 5 have complementary abutting relative sliding surfaces 3 and 4, respectively, located within the interior of outer jacket 9. Stationary refractory plate 2 has therethrough a flow passage 14 which is in communication with the pouring opening 13. Rotary refractory plate 5 has therethrough at least one flow passage 15 which, upon rotation of plate 5, may be selectively moved into and out of alignment with flow passage 14. A thermal insulating discharge member 7 may be mounted, in a known manner, to the bottom surface of rotary refractory plate 5, and a pouring spout or discharge pipe 8 may extend downwardly from member 7. Member 7 has therein a flow passage 16 communicating with flow passage 15 in plate 5, and member 7 and spout 8 rotate with rotary refractory plate 5. Member 7 operates to increase heat concentration at the sliding surfaces 3 and 4. Spout 8 protects various metal components [not shown] from the heat of a discharged melt.

Due to the positioning of the stationary refractory plate 2 and the rotary refractory plate 5 within the container jacket 9, and by providing pouring opening 13 of a wide dimension, the sliding surfaces 3 and 4 are exposed to the high temperatures of the liquid melt within the container. This tends to counteract any tendency towards solidification of any liquid melt between surfaces 3 and 4 and in flow passage 14 when the rotary closure unit is in the closed position thereof. This effect is considerably increased by a novel feature of the present invention.

Thus, the stationary refractory plate 2 is formed of a soft, highly heat conducting material, and rotary refractory plate 5 is formed of a hard material having a relatively low thermal conductivity. By these features, the heat of the melted material is absorbed by the stationary refractory plate 2, is directed to the sliding surfaces 3 and 4, and is accumulated thereat by the rotary refractory plate 5 and the member 7. Specifically, stationary refractory plate 2 consists essentially of a material having a Mohs' hardness of from 1 to 2 and a thermal conductivity of greater than 40 W/km at 700° C. Rotary refractory plate 5 consists essentially of a material having a Mohs' hardness of from 6 to 7 and a thermal conductivity of less than 3 W/km at 700° C. These features create a heat concentration at the sliding surfaces 3 and 4, thereby preventing solidification of any small amounts of liquid melt which might become infiltrated between surfaces 3 and 4.

In accordance with a further novel feature of the present invention, there is provided an excellent self lubrication of the surfaces 3 and 4 of the plates 2 and 5, respectively. Such lubrication is sufficient to substantially inhibit the penetration of liquid melt between the surfaces 3 and 4. Thus, the material of plate 2 is substantially non-wettable and is relatively soft, i.e. having a crushing strength not greater than 25 $N/mm^2$ at approximately room temperature. Plate 5 is formed of a substantially non-porous material having a crushing strength of greater than 300 $N/mm^2$ at approximately room temperature. Accordingly, any substantially non-wettable particles which might become worn off surface 3 of soft stationary refractory plate 2 close off open pores of the sliding surfaces and tend to push back the melted material at the edges of the sliding surfaces at flow passages 14, 15.

Plate 2 can be a tempered, not annealed at high temperature, carbon block containing at least 90% by weight of graphite. Granular carbon which has been graphitized is generally known as a raw material for production of graphite electrodes. This same raw material, after being pressed into a block shape and then tempered, can be employed as plate 2 of the present invention.

Plate 5 may be made of a mixture of oxides, containing at least 90% by weight of zirconia or alumina, in the form of a burned, stone or brick. There can be other oxides in the mixture, in addition to the zirconia and/or alumina, such as $SiO_2$, $Cr_2O_3$ and $Fe_2O_3$.

Although the present invention has been described and illustrated with respect to a preferred embodiment thereof, it is to be understood that various modifications and changes may be made without departing from the scope of the present invention.

We claim:

1. In a sliding closure unit for selectively discharging liquid melt from a liquid melt container of the type including an outer jacket, an inner refractory lining and a pouring opening extending through the lining, said sliding closure unit cooperating with the container for selectively blocking and unblocking the pouring opening and including a stationary refractory plate having therethrough a flow passage for communication with the pouring opening, a sliding refractory plate in abutting contact with said stationary refractory plate and having therethrough at least one flow passage to be selectively moved into and out of alignment with said flow passage of said stationary refractory plate, said stationary and sliding refractory plates having complementary, abutting relative sliding surfaces, the improvement wherein:

said stationary refractory plate consists essentially of a substantially non-wettable material having a Mohs' hardness of from 1 to 2, a thermal conductivity of greater than 40 W/km at 700° C. and a crushing strength of not greater than 25 $N/mm^2$ at about room temperature; and said sliding refractory plate consists essentially of a substantially non-porous material having a Mohs' hardness of from 6 to 7, a thermal conductivity of less than 3 W/km at 700° C. and a crushing strength of greater than 300 $N/mm^2$ at about room temperature.

2. The improvement claimed in claim 1, wherein said stationary refractory plate consists essentially of carbon having a graphite content of at least 90% by weight.

3. The improvement claimed in claim 1 or 2, wherein said sliding refractory plate contains at least 90% by weight of a material selected from the group consisting of zirconia and alumina.

4. The improvement claimed in claim 1, further comprising a thermal insulating member supported outwardly of said sliding refractory plate.

5. The improvement claimed in claim 1, wherein said sliding refractory plate is mounted for rotary movement with respect to said stationary refractory plate.

6. The improvement claimed in claim 1, wherein said sliding refractory plate is mounted for linear movement with respect to said stationary refractory plate.

* * * * *